US006137462A

United States Patent [19]

Kim

[11] Patent Number: 6,137,462

[45] Date of Patent: Oct. 24, 2000

[54] LIQUID CRYSTAL DISPLAY DRIVING CIRCUIT

[75] Inventor: Jun-Hee Kim, Seoul, Rep. of Korea

[73] Assignee: LG Electronics Inc., Seoul, Rep. of Korea

[21] Appl. No.: 08/850,099

[22] Filed: May 1, 1997

[30] Foreign Application Priority Data

May 2, 1996 [KR] Rep. of Korea ..... 96-14278

[51] Int. Cl.[7] ..... G09G 3/36

[52] U.S. Cl. ..... 345/94; 345/95; 345/99; 345/100

[58] Field of Search ..... 345/94, 95, 100, 345/89, 50, 53, 87, 99; 340/784

[56] References Cited

U.S. PATENT DOCUMENTS

| | | | |
|---|---|---|---|
| 5,170,155 | 12/1992 | Plus et al. | 340/784 |
| 5,317,401 | 5/1994 | Dupont et al. | 345/94 |
| 5,638,088 | 6/1997 | Manno et al. | 345/95 |
| 5,682,177 | 10/1997 | Kuwata et al. | 345/100 |
| 5,684,502 | 11/1997 | Fukui et al. | 345/95 |
| 5,686,933 | 11/1997 | Okada et al. | 345/95 |
| 5,767,836 | 6/1998 | Scheffer et al. | 345/89 |

FOREIGN PATENT DOCUMENTS 5-35218 2/1993 Japan .

OTHER PUBLICATIONS

Alan G. Lewis et al., "Driver Circuits for AMLCDs", Xerox Palo Alto Research Center, Palo Alto, CA, pp. 56–64.

*Primary Examiner*—Vijay Shankar
*Attorney, Agent, or Firm*—Finnegan, Henderson, Farabow, Garrett & Dunner, L.L.P.

[57] ABSTRACT

Liquid crystal display (LCD) driving circuit in which a small number of voltage sources enable multi-gradation display and gamma correction without extra gamma correction circuits is disclosed. The LCD driving circuit includes a ramp wave generator for generating a plurality of ramp waves each having an appropriate tilt for each section along a T axis of a T-V (transmission-voltage) curve representing the light transmittivity of an LCD according to an applied voltage, a ramp wave selector for selecting one of the plurality of ramp waves according to input data, and a counter for adjusting the time the ramp wave outputted by the ramp wave selector is applied.

20 Claims, 7 Drawing Sheets

LIQUID CRYSTAL DISPLAY DRIVING CIRCUIT

BACKGROUND OF THE INVENTION

1. Field of the Invention

The present invention relates to driving a liquid crystal display and, more particularly, to a liquid crystal display (LCD) driving circuit in which a small number of voltage sources enable multi-gradation display, and gamma correction can be obtained without extra gamma correction circuits.

2. Discussion of the Related Art

A liquid crystal display (LCD) has generally been mounted in a personal computer (PC). Currently, a standard LCD displays 512 colors using a 6 bit digital driver.

Since image information and communication information have been available in a computer, an LCD has been required to display more than 64 gradations (0.26 million colors) for each of R, G, and B. Currently, the transmittivity (luminosity of an amount of transmitted light) of an LCD is changed according to an applied voltage, as shown in the T-V (transmission-voltage) curve of FIG. 1. Displaying methods are divided into a normally white and a normally black, depending on whether the state in which a voltage is not applied results in a white mark or a black one. FIG. 1 applies to the case of the normally black mode. Referring to FIG. 1, the change of transmittivity is nonlinear according to the change in voltage in sections o-a and c-d, and more linear in section a-c. The goal of gamma correction is to make the whole T-V curve linear by making sections o-a and c-d linear. As shown in FIG. 2, line 3, which represents the change in voltage of the T-V curve, is corrected with line 1, thus making the T-V line linear, as shown by line 2.

FIG. 3 is a block diagram of a conventional gamma correction circuit, which includes an analog/digital (A/D) converter 11 for converting an analog image signal into a digital signal; a detecting part 12 for determining a digital value converted by the A/D converter 11 and providing an address for a lookup table 13 having a gamma value; a lookup table 13 for outputting the gamma value stored in the address provided by the detecting part 12; an adder 14 for adding an output of the A/D converter 11 and an output of the lookup table 13; and a D/A converter 15 for converting an output coming from the adder 14 into an analog signal.

The analog image signal inputted is converted into a digital value by the A/D converter 11 and finally is outputted into the detecting part 12 and the adder 14. The detecting part 12 determines the digital value converted and outputs a corresponding address into the lookup table 13. The lookup table 13 outputs into the adder 14 a gamma value recorded at the address provided by the detecting part 12. The gamma value necessary to make the T-V curve linear is already recorded in the lookup table 13. Accordingly, the output of the A/D converter 11 and that of the lookup table 13 are added in the adder 14, and then the added value is converted into an analog signal in the D/A converter 15, thereby making the T-V curve linear, like the line 2 of FIG. 2.

However, preciseness of the gamma correction is cut off due to a round off error which is generated when the analog signal is converted into the digital signal. Also, as a voltage source is increased, gradations are difficult to display, requiring an extra circuit and memory to perform gamma correction. As a result, the entire circuit is enlarged, increasing power consumption and manufacturing cost.

Referring to FIG. 4, there is another method for making a T-V curve linear by carrying out gamma correction, namely, by using ramp waves. In FIG. 4, "t1" is a time which is spent to increase one count value. Accordingly, if the tilt of a ramp is constant, there will be a voltage V2 between a voltage V1 at a time point ta and a voltage V3 at a time point tb for the gamma correction, and the counter should be fast to obtain V2.

For example, in FIG. 4, it is sufficient that a counter can count up to 64 in the case of 6 bit data. However, since a time point between ta and tb is needed to obtain the V2, about 8 bits should be processed during the same time. Accordingly, a lookup table shown in FIG. 3, such as a read only memory (ROM), is needed and a high speed counter is needed to process the extended data. This enlarges the entire circuit, increasing power consumption and manufacturing cost.

SUMMARY OF THE INVENTION

Therefore, the present invention is directed to an LCD driving circuit that substantially obviates one or more of problems due to limitations and disadvantages of the related art.

An object of the present invention is to provide an LCD driving circuit in which a plurality of ramp waves having different tilts are generated to obtain different voltages at the same time point, so that gamma correction can be achieved without an extra gamma correction circuit.

Another object of the invention is to provide an LCD driving circuit in which a T-V curve is divided into predetermined sections and ramp waves are generated to have different tilts according to the sections. Each of the ramp waves is added to a voltage corresponding to each section, whereby multi-gradation display is enabled by a small number of voltage sources and gamma correction is available without an extra gamma correction circuit.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the liquid crystal display (LCD) driving circuit includes a ramp wave generating means for generating a plurality of ramp waves each having an appropriate tilt for each section along a T axis of a T-V (transmission-voltage) curve representing the light transmittivity of an LCD according to an applied voltage, a ramp wave selecting means for selecting one of the plurality of ramp waves according to input data, and a count means for adjusting the time the ramp wave outputted by the ramp wave selecting means is applied.

In another aspect, there is provided another LCD driving circuit which includes a voltage generating means for generating voltage sources each corresponding to sections along a T axis of a T-V (transmissivity-voltage) curve representing the light transmittivity of an LCD according to an applied voltage, a ramp wave generating means for generating ramp waves each having an appropriate tilt for each of the sections, an adding means for adding the voltage source and ramp wave generated from the voltage generating means and the ramp wave generating means, respectively, for a corresponding section, and a count means for adjusting the time an adding result of the adding means is applied.

In another aspect, a method for driving an LCD includes the steps of generating a plurality of ramp waves each having an appropriate tilt for each section along a T axis of a T-V (transmission-voltage) curve representing the light transmittivity of an LCD according to an applied voltage, selecting one of the plurality of ramp waves according to input data, and a time the ramp wave outputted by the ramp wave selecting means is applied.

In another aspect, a method for driving an LCD includes the steps of generating voltage sources each corresponding to sections along a T axis of a T-V (transmissivity-voltage) curve representing the light transmittivity of an LCD according to an applied voltage,generating ramp waves each having an appropriate tilt for each of the sections, adding the voltage source and ramp wave generated from the voltage generating means and the ramp wave generating means, respectively, for a corresponding section, and adjusting the time an adding result of the adding means is applied.

It is to be understood that both the foregoing general description and the following detailed description are exemplary and explanatory only and are intended to provide further explanation of the invention as claimed.

BRIEF DESCRIPTION OF THE DRAWINGS

These and various other objects, features, and advantages of the present invention will be readily understood with reference to the following detailed description read in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

First embodiment of the invention

Figure 5:
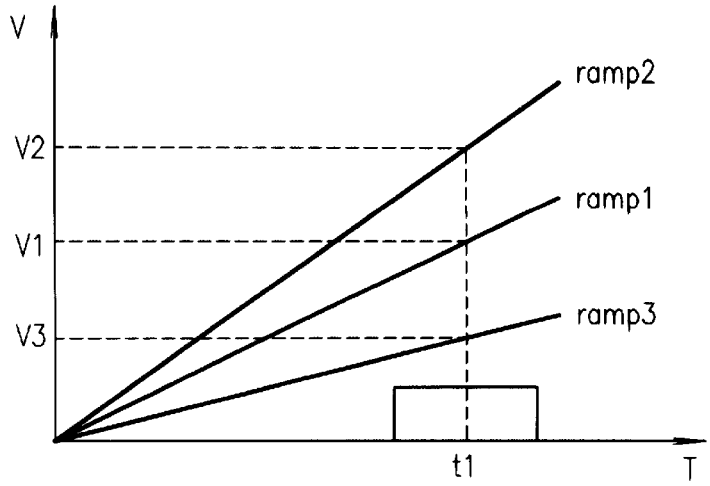
FIG. 5 is a ramp wave form chart for making the T-V curve of FIG. 1 linear by using an LCD driving circuit consistent with a first embodiment of the invention.

FIG. 5 shows ramp wave forms of different tilts generated by an LCD driving circuit according to a first embodiment of the invention. Note that voltages V1, V2, and V3 are obtained in one time point t1. Accordingly, a tilt for gamma correction is already set for each section of a TFT-LCD T-V curve, and then a section is selected according to inputted data. A predetermined ramp voltage is applied to the selected section, and a switch is adjusted to be on or off by using a counter, thus obtaining the voltage applied to the final panel.

Figure 6:
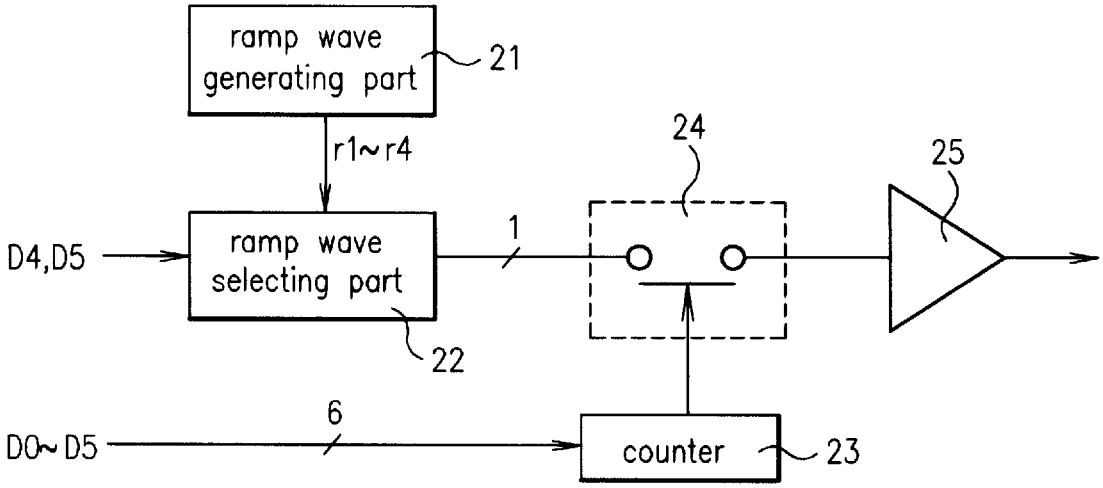
FIG. 6 is a structural block diagram of the LCD driving circuit consistent with the first embodiment of the invention.

FIG. 6 is a structural block diagram of the LCD driving circuit consistent with the first embodiment of the invention. For explanatory purposes, the input data is chosen to be 6 bits. However, the inputted data and the section of the T-V curve can be chosen differently according to the characteristics of a particular panel.

Referring to FIG. 6, the LCD driving circuit includes a ramp wave generating part 21 for generating ramp waves each having a different tilt at each section, a selecting part 22 for selecting the ramp waves generated by the ramp wave generating part 21 according to inputted data, a counter 23 for counting the inputted data, a switching part 24, responsive to an output of the counter 23, for outputting the ramp wave selected by the ramp wave selecting part 22, and a buffer 25 for temporarily latching an output of the switching part 24.

For 6 bit input data, the selecting part 22 selects a ramp wave by receiving front 2 bits D5 and D4. The counter 23 counts 6 bits of the input data in sequence so as to control the switching part 24. In this case, the tilt of the ramp wave generated by the ramp wave generating part 21 for gamma correction is already properly set for each section according to the T-V curve of the TFT-LCD.

Figure 7:
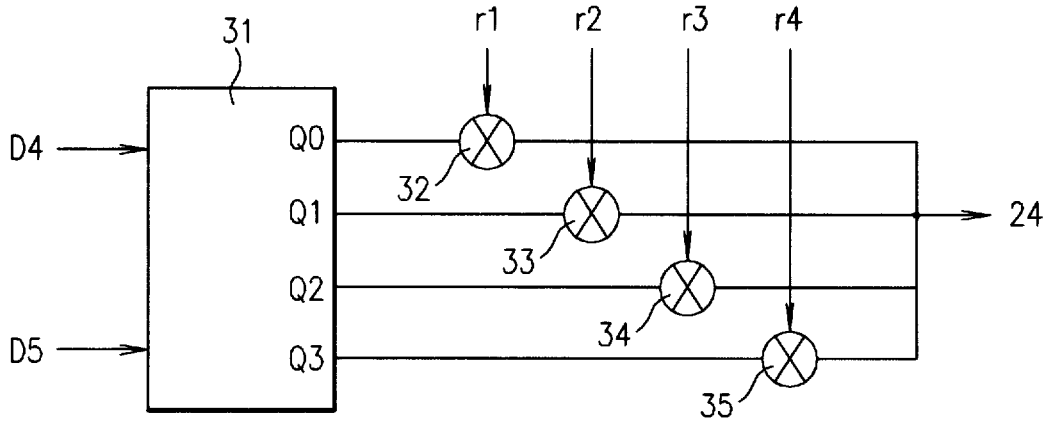
FIG. 7 is a detailed circuit diagram of the ramp wave selecting part of FIG. 6.

FIG. 7 is a detailed block diagram of the selecting part 22 of FIG. 6. It includes a decoder 31 for enabling a corresponding output among a plurality of outputs according to values of input data D5 and D4. It also includes analog switches 32, 33, 34, and 35 for outputting a corresponding ramp wave when switched on by the output of the decoder 31. The analog switch 32 outputs a first ramp wave r1 generated by the ramp wave generating part 21 when switched on by an output value Q0 of the decoder 31. The analog switch 33 outputs a second ramp wave r2 generated by the ramp wave generating part 21 when switched on by an output value Q1 of the decoder 31. The analog switch 34 outputs a third ramp wave r3 generated by the ramp wave generating part 21 when switched on by an output value Q2 of the decoder 31. The analog switch 35 outputs a fourth ramp wave r4 generated by the ramp wave generating part 21 when switched on by an output value Q3 of the decoder 31. The output ports of the analog switches 32, 33, 34, and 35 are all connected to switching part 24.

According to the first embodiment of the invention having the above-described structure, the front 2 bits D5 and D4 of the input data are used for selecting a ramp wave form of each section, and the 6 bits D5 to D0 are used for the counter 23. The ramp wave generating part 21 generates ramp waves r1 to r4 having different tilts so as to correct the T-V curve at each section, as shown in FIG. 6.

The selecting part 22 selects a corresponding ramp wave among the ramp waves generated by the ramp wave generating part 21 according to the values of the front 2 bits D5 and D4 among the input data. For example, if D5 and D4 are 00, the output Q0 of the decoder 31 is enabled and the other outputs Q1 to Q3 are disabled. Accordingly, the analog switch 32 of the selecting part 22 is on and the other analog switches 33 to 35 are off, so that only the first ramp wave r1 inputted into the analog switch 32 is outputted into the switching part 24. Or, if D5 and D4 are 01, the output Q1 of the decoder 31 is enabled and the rest of the outputs Q0, Q2, and Q3 are disabled, so that only the second ramp wave r2 is outputted into the switching part 24. In the same manner, if D5 and D4 are 10, only the third ramp wave r3 is outputted into the switching part 24. If D5 and D4 are 11, only the fourth ramp wave r4 is outputted into the switching part 24.

The counter 23 counts the input data from 0 to 63 in sequence and switches the switching part 24 on or off. That is, the switching part 24 is on while the counter 23 is counting, and is off when the counter is finished. While the switching part 24 is on, it applies a ramp voltage into the buffer 25 through the ramp selecting part 22. That is, the switching part 24 applies into the buffer a ramp voltage of a different tilt which has already been set by the T-V curve of the panel according to bits D4 and D5. This buffer 25 latches an output of the switching part 24 for a predetermined time after switching part 24 is turned off.

Thus, the sections of the T-V curve are corrected by a ramp wave form of a different tilt according to the characteristics of the T-V curve, so that the counter enables the gamma correction without extending the number of data bits, and without a gamma correction circuit.

Second embodiment of the invention

Figure 1:
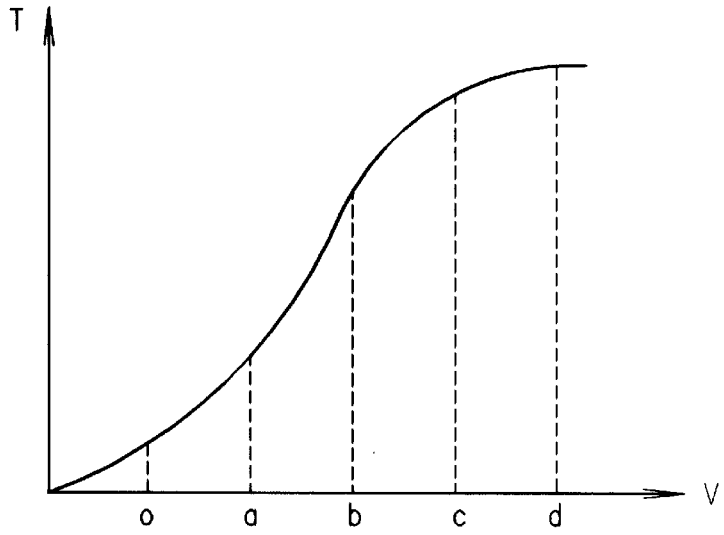
FIG.1 prior art
FIG. 1 is a graph showing a general relationship between a transmittivity and a voltage (T-V)
Figure 2:
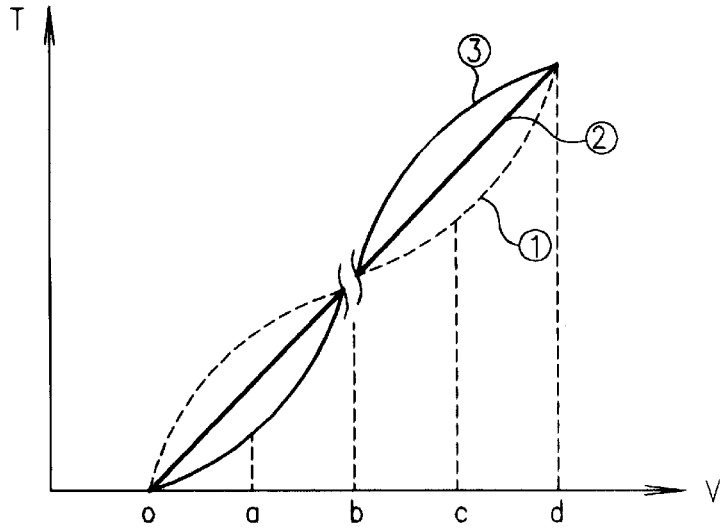
FIG.2 prior art
FIG. 2 is a graph showing the process for making the T-V curve of FIG. 1 linear.
Figure 3:
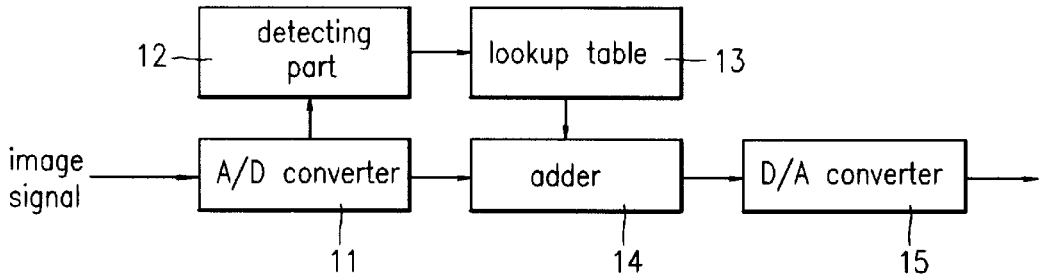
FIG.3 prior art
FIG. 3 is a block diagram of a conventional gamma (γ) correction circuit.
Figure 4:
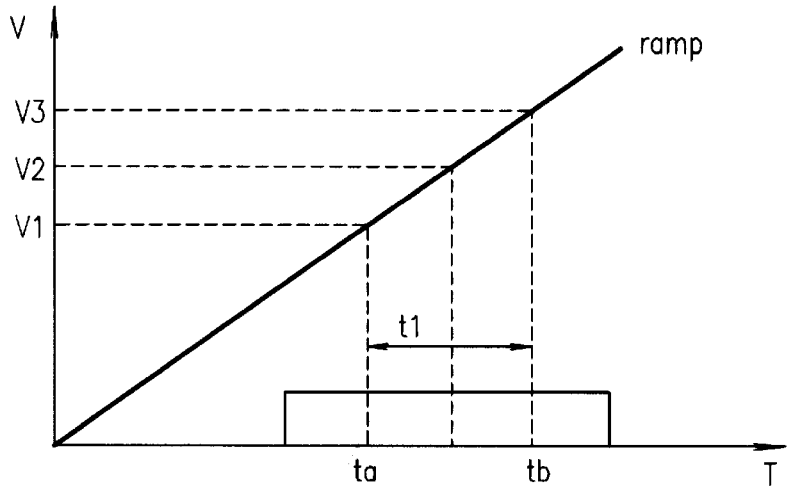
FIG.4 prior art
FIG. 4 is a conventional ramp wave form chart for making the T-V curve of FIG. 1 linear.
Figure 8:
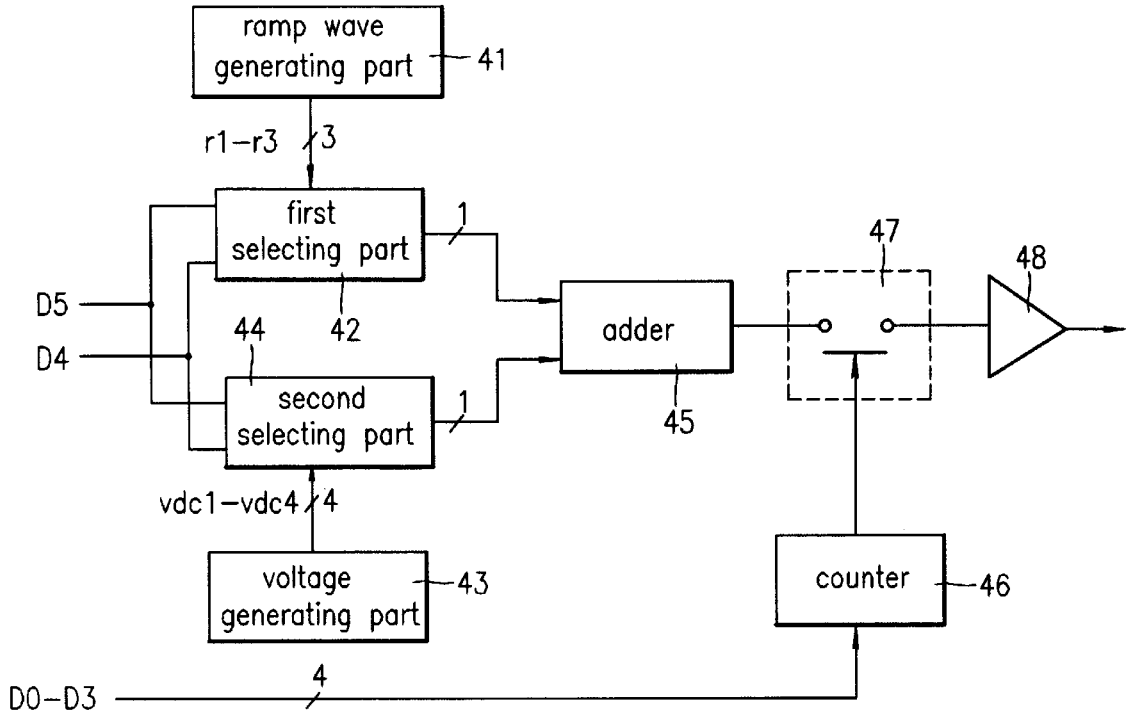
FIG. 8 is a structural block diagram of an LCD driving circuit consistent with a second embodiment of the invention.

FIG. 8 is a structural block diagram of an LCD driving circuit according to a second embodiment of the invention. For explanatory purposes, the input data is set to be 6 bits and the T-V curve is divided into sections as shown in FIG. 1. The input data and the section division of the T-V curve can be changed according to the characteristics of a particular panel.

As shown in FIG. 8, an LCD driving circuit includes a ramp wave generating part 41 for generating a plurality of ramp waves having different tilts, a first selecting part 42 for selecting the ramp waves generated by the ramp wave generating part 41, a voltage generating part 43 for generating a direct current (DC) voltage corresponding to each section, a second selecting part 44 for selecting the DC voltage generated by the voltage generating part 43, an adder 45 for adding the ramp wave and a level of the DC voltage generated from the first and second selecting parts 42 and 44, respectively, a counter 46 for counting input data, a switching part 47 for outputting the result of the adder 45 when switched on according to an output of the counter 46, and a latch 48 for latching an output of the switching part 47. The first and second selecting parts 42 and 44 receive front 2 bits D5 and D4 and select the ramp wave and the DC level at the same time, and the counter 46 counts the rear 4 bits of the input data so as to control the switching part 47.

Figure 9:
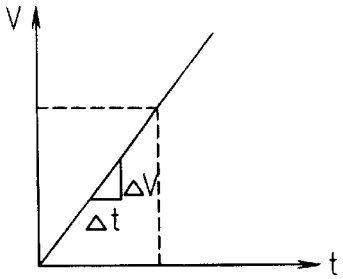
FIGS. 9*a* to 9*c* are ramp wave form charts of ramp waves of different tilts generated by the ramp wave generating part of FIG. 8.
Figure 9:
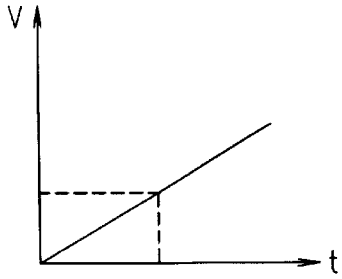
Figure 9:
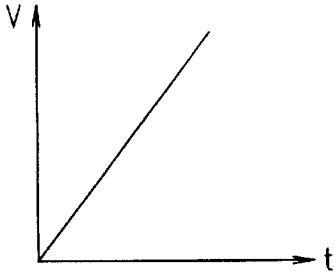

FIGS. 9*a* to 9*c* show the outputs of the ramp wave generating part 41. For the sections shown in FIG. 1, FIG. 9*a* is a ramp wave for correction of the section o-a, FIG. 9*b* is a ramp wave for correction of the section a-c, and FIG. 9*c* is a ramp wave for correction of the section c-d. The tilts of the ramp waves generated by the ramp wave generating part 41 are set according to the characteristics of a particular panel.

Figure 10:
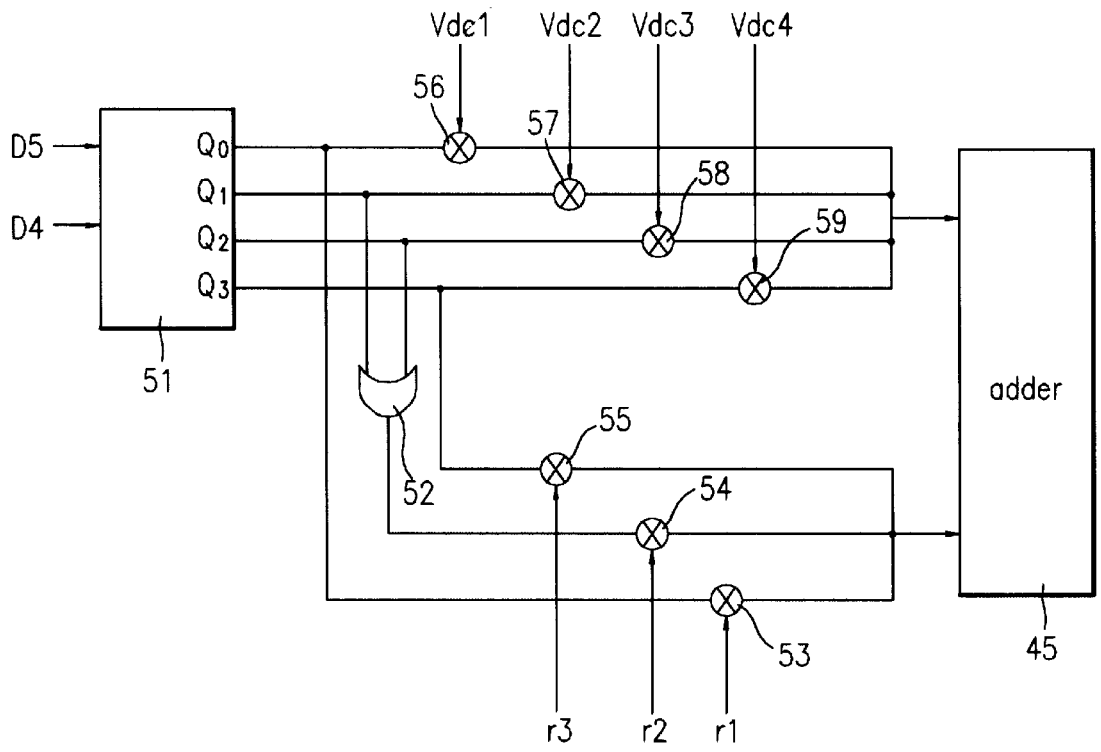
FIG. 10 is a detailed circuit diagram of the first and second selecting parts of FIG. 8.

FIG. 10 is a detailed block diagram of the first and second selecting parts 42 and 44 of which each includes a decoder 51 for selecting an output among a plurality of outputs according to the values of input data D5 and D4, an OR gate 52 for logically combining outputs Q1 and Q2 of the decoder 51, analog switches 53 to 55 for outputting a corresponding ramp wave when switched according to the outputs of the decoder 51 and the OR gate 52, and analog switches 56 to 59 for outputting a corresponding DC level when switched by the output of the decoder 51.

The analog switch 53 is switched according to an output value Q0 of the decoder 51 for outputting a first ramp wave r1 generated by the ramp wave generating part 41. The analog switch 54 is switched according to an output value of the OR gate 52 for outputting a second ramp wave r2 generated by the ramp wave generating part 41. The analog switch 55 is switched according to an output value Q3 for outputting a third ramp wave r3 generated by the ramp wave generating part 41.

The analog switch 56 is switched according to an output value Q0 of the decoder 51 for outputting a first DC voltage Vdc1 generated by the voltage generating part 43. The analog switch 56 is switched according to an output value Q1 of the decoder 51 for outputting a second DC voltage Vdc2 generated by the voltage generating part 43. The analog switch 58 is switched according to an output value Q2 of the decoder 51 for outputting a third DC voltage Vdc3 generated by the voltage generating part 53. The analog switch 59 is switched according to an output value Q3 of the decoder 51 for outputting a fourth DC voltage Vdc4 generated by the voltage generating part 43.

Output ports of the analog switches 53 to 55 are all commonly connected to the adder 45, as are the output ports of the analog switches 56 to 59.

Figure 11:
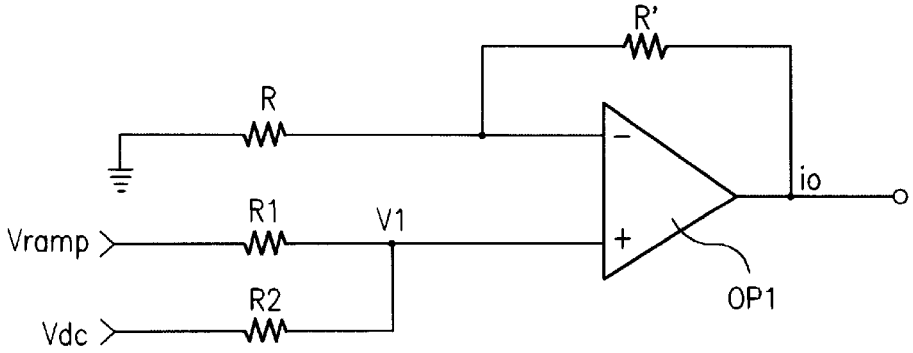
FIG. 11 is a detailed circuit diagram of the adder of FIG. 8.

FIG. 11 is a detailed circuit diagram of the adder 45, which is a non-inverting type adder using an operational amplifier. That is, an inverting input port (−) of the operational amplifier OP1 is grounded through a resistor R. The ramp voltage Vramp and the DC voltage Vdc are commonly inputted into the non-inverting input port (+) through resistors R1 and R2, respectively. A negative feedback resistor R' is connected between the output port and the inverting port (−). The ramp voltage Vramp is one of ramp waves outputted by being selected by the first selecting part 42. The DC voltage Vdc is one of DC voltages Vdc1 to Vdc4 which are outputted when selected by the second selecting part 44.

Since the data is 6 bits, 64 gradations should be displayed. Since the T-V curve is divided into 4 sections, only 16 gradations per section are displayed. In this case, the front 2 bits D4 and D5 of the input data are used for the selection of DC voltages and ramp wave forms, and the rear 4 bits D3 to D0 are used for the counter. Ramp waves r1 to r3 are generated in the ramp wave generating part 41 as shown in FIGS. 9*a* to 9*c* in order to correct the T-V curve in each of the sections. According to each of the sections, the voltage generating part 43 generates DC voltages, such as DC voltages Vdc1 to Vdc4 corresponding to a, b, c, and d. If the T-V curve is divided into the four sections, i.e. o, a, b, c, and d as shown in FIG. 1, FIG. 9*a* is a ramp wave for correcting the section o-a; FIG. 9*b* is a ramp wave for correcting the section a-c; and FIG. 9*c* is a ramp wave for correction the section c-d.

Accordingly, having selected a corresponding ramp wave among ramp waves generated by the ramp wave generating part 41 according to the values of the front bits D5 and D4, the first selecting part 42 outputs it to the adder 45. Having selected a corresponding DC voltage among DC voltages generated by the voltage generating part 43, the second selecting part 44 outputs it to the adder 45. For example, if D5 and D4 are 00, the output Q0 of the decoder 51 is enabled and the rest of the outputs Q1 to Q3 are disabled. Accordingly, the analog switch 53 of the first selecting part 42 is on and the rest of the analog switches 54 and 55 are off, such that only the first ramp wave r1 inputted into the analog switch 53 and shown in FIG. 9*a* is outputted into the adder 45. Similarly, the analog switch 56 of the second selecting part 44 is on, and the rest analog switches 57 to 59 are off, such that only the first DC voltage Vdc1 inputted into the analog switch 56 is outputted into the adder 45.

If D5 and D4 are 01, the output Q1 of the decoder 51 is enabled and the rest outputs Q0, Q2, and Q3 are disabled. Accordingly, the output of the OR gate 52 of the first selecting part 42 is high such that the analog switch 54 is on and the rest of the analog switches 53 and 55 are off. As a result, the second ramp wave r2 inputted into the analog switch 54 and shown in FIG. 9*b* is outputted into the adder 45. Also, the analog switch 57 of the second selecting part 44 is on, and the rest of the analog switches 56, 58, and 59 are off, such that only the second DC voltage Vdc2 inputted into the analog switch 57 is outputted into the adder 45. Also, if D5 and D4 are 10, the second ramp wave r2 of FIG. 9*b* and the third DC voltage Vdc3 are selected and outputted into the adder 45. If D5 and D4 are 11, the third ramp wave r3 of FIG. 9*c* and the fourth DC voltage Vdc4 are selected by the first and second selecting parts 42 and 44 so as to be outputted into the adder 45. That is, the selected ramp and the DC voltage depend on the front 2 bits D5 and D4 as in Table 1.

TABLE 1

| D5 | D4 | Vramp | Vdc |
|---|---|---|---|
| 0 | 0 | r1 | Vdc1 |
| 0 | 1 | r2 | Vdc2 |
| 1 | 0 | r2 | Vdc3 |
| 1 | 1 | r3 | Vdc4 |

The adder 45 adds the ramp voltage and the DC voltage selected by the first and second selecting parts 42 and 44, respectively. At this time, the ramp voltage Vramp is one of ramp waves r1 to r3 selected by the first selecting part 42, and the DC voltage Vdc is one of the DC voltages Vdc1 to Vdc4 selected by the second selecting part 44.

Since the adder 45 is a non-inverting type adder using an operation amplifier, a ramp voltage selected by the first selecting part 42 is inputted into the non-inverting input port (+) of the operation amplifier OP1 through the resistor R1, and the DC voltage selected by the second selecting part 44 is inputted into the non-inverting input port (+) through the R2. The inverting port (−) of the operational amplifier OP1 is grounded through the resistor R.

The current flowing through resistors R1 and R2 in the adder input is determined by the ramp voltages, the DC voltage, and the resistor values R1 and R2. If R1 is equal to R2, V+=(Vramp+Vdc)/2, and the output io of the adder is (1+R'/R)V+. Also, if R' is equal to R, i=2×(Vramp+Vdc)/2=Vramp+Vdc. Here, the DC voltage outputted by the second selecting part 44 becomes an offset voltage of the ramp voltage selected and outputted by the first selecting part 42. For example, as shown in FIG. 12*a*, if the second ramp wave r2 and the third DC voltage Vdc3 are selected when D5 and D4 are 10, the output of the adder 45 is increased to the second ramp wave form r2 from the third DC voltage Vdc3 until the counter 46 is finished counting.

The switching part 47 is on while the counter 46 is counting. It is off when the counting is finished. The latch 48 latches an output of the adder 45 for a predetermined time after the switching part 47 is turned off.

Figure 12A:
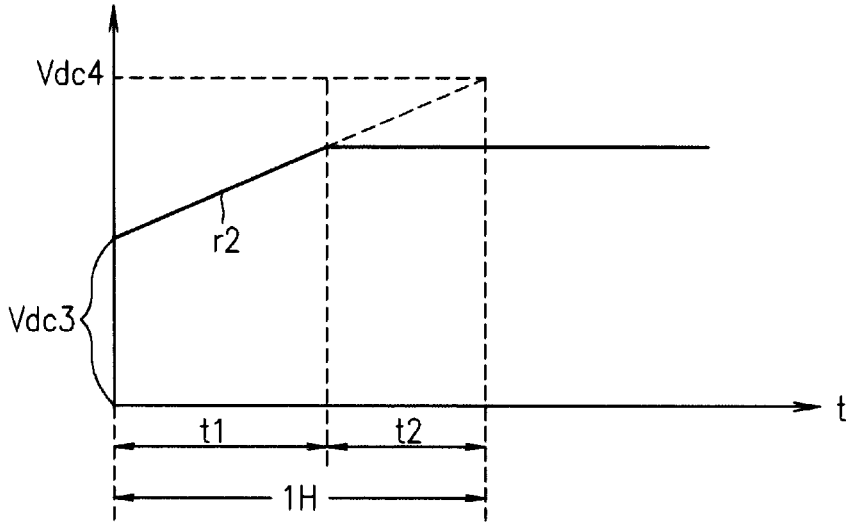
FIGS. 12*a* and 12*b* are graphs showing processes for making a T-V curve linear.
Figure 12B:
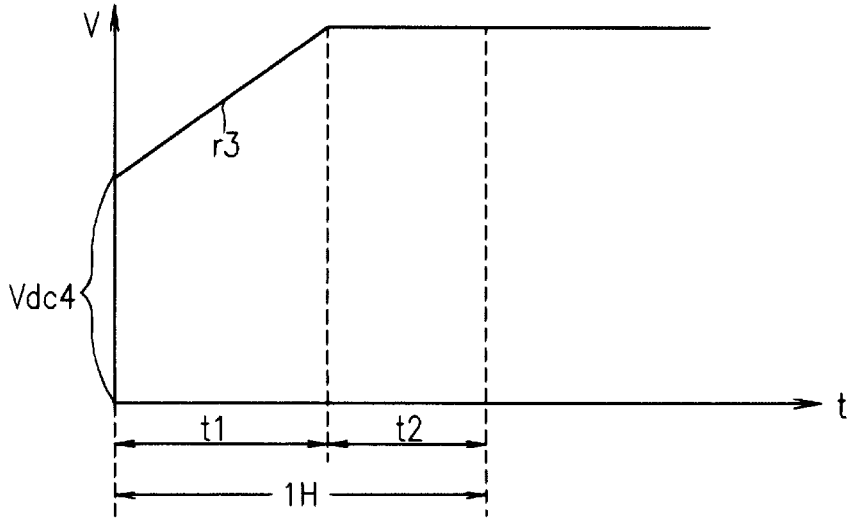

Shown in FIG. 12*a*, "t1" is a time for counting and "t2" is a time for latching. The addition of t1 and t2 is a selecting period 1 H of the line 1. The count time of the counter 46 depends of the rear 4 bits of the input data. For example, if D3, D2, D1, and D0 are 1111, the counter 46 counts from θ to 15; if they are 0111, it counts from 0 to 7. Also, if, as shown in FIG. 12*b*, the third ramp wave r3 and the fourth DC voltage Vdc4 are selected by the first and second selecting parts 42 and 44 respectively, an output of the adder 45 is increased to the third ramp wave r3 from the fourth DC voltage Vdc4 until the counter 46 is finished counting. When the count function is finished, the output is maintained by the latch 48.

Figure 13:
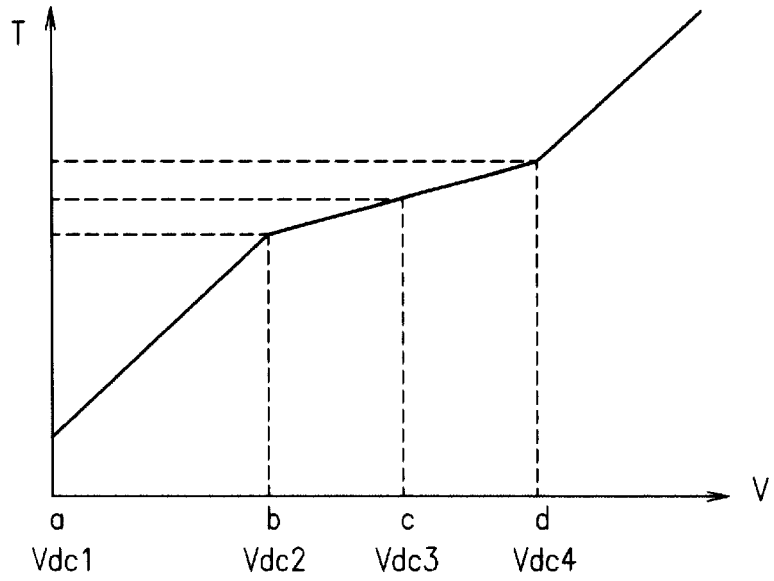
FIG. 13 is a graph showing a T-V curve according to the invention.

As described previously, gamma correction is obtained without any gamma correction circuit by virtue of correction by ramp wave forms having different tilts in the T-V curve according to the T-V curve characteristics, thereby making the T-V curve linear as shown in FIG. 13. Since the T-V curve is divided into four sections, 16 gradations are in each space between adjacent sections, whereby the counter 46 need only count the rear 4 bits so as to display the multiple gradations. As a result, the multiple gradations can be displayed using a small number of voltage sources while the counter 46 is less burdened. Accordingly, when the number of input data bits is increased, since only the operation frequency of the counter 46 in each space between adjacent sections need be increased, the counter becomes less burdened.

Third embodiment of the invention

Figure 14:
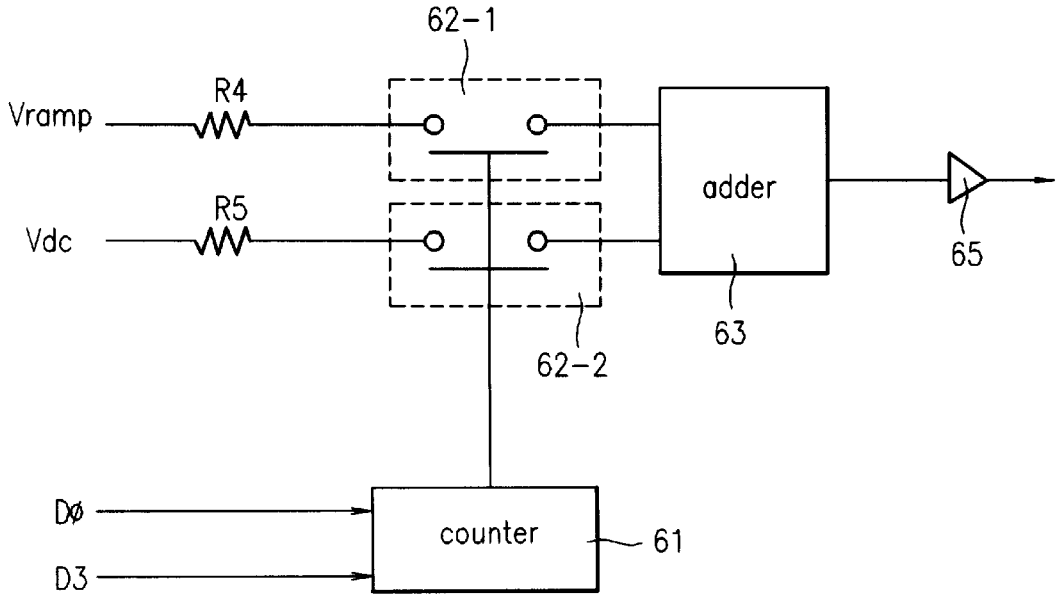
FIG. 14 is a structural block diagram of an LCD driving circuit consistent with a third embodiment of the invention.

FIG. 14 is a structural block diagram of an LCD driving circuit according to a third embodiment of the invention. The function of the LCD driving circuit is same as that of FIG. 8. However, a switching part is placed in front of the adder.

A ramp voltage Vramp selected by a first selecting part 42 is inputted into a first switching part 62-1 through a resistor R4. A DC voltage Vdc selected by a second selecting part 44 is inputted into the switching part 62-2 through a resistor R5. The first and second switching parts 62-1 and 62-2 are turned on or off by the control of a counter 61. Outputs of the first and second switching parts 62-1 and 62-2 are inputted into the adder 63 and an output of the adder 63 is inputted into a latch 65.

Each of the tilts of the ramp waves generated by the ramp wave generating means can be $((V_{i+1}+V_i)\times 1\ H)$, in which $V_{i+1}$ is a voltage of a section right after a predetermined number of sections, and $V_i$ is a voltage of a section just prior to the section, and 1 H is a selecting time of line 1.

According to the LCD driving circuit consistent with the present invention, a ramp voltage having a different tilt predetermined by a T-V curve of a panel according to a data section is outputted to make the T-V curve linear, such that gamma correction can be obtained without extra gamma correction circuits, thereby reducing power consumption.

Further, by dividing the T-V curve into a predetermined number of sections, and by generating and adding the DC voltage and ramp wave in each section thereto, the T-V curve is linearized. As a result, multiple gradations can be displayed with a small number of voltage sources, thus lessening the burden on the counter 46. Thus, gamma correction is provided without additional gamma correction circuits, reducing power consumption and cost.

It will be apparent to those skilled in the art that various modification and variations can be made in the LCD driving circuit of the present invention without departing from the spirit or scope of the invention. Thus, it is intended that the present invention cover the modifications and variations of this invention provided they come within the scope of the appended claims and their equivalents.

What is claimed is:

1. A liquid crystal display (LCD) driving circuit comprising:

a ramp wave generating means for generating a plurality of ramp waves each having an appropriate tilt for each section along a T axis of a T-V (transmission-voltage) curve representing the light transmittivity of an LCD according to an applied voltage;

a ramp wave selecting means for selecting one of the plurality of ramp waves according to input data; and, a count means for adjusting the time the ramp wave outputted by the ramp wave selecting means is applied.

2. The LCD driving circuit as claimed in claim 1, wherein the count means comprises:

a counter for counting the input data in sequence;

a switching part responsive to the counter for outputting the ramp wave selected by the ramp wave selecting means; and, a buffer for maintaining the ramp wave outputted by the switching part for a predetermined time after the switching part is turned off.

3. A liquid crystal display (LCD) driving circuit comprising:

a voltage generating means for generating voltage sources each corresponding to sections along a T axis of a T-V (transmissivity-voltage) curve representing the light transmittivity of an LCD according to an applied voltage; a ramp wave generating means for generating ramp waves each having an appropriate tilt for each of the sections; an adding means for adding the voltage source and ramp wave generated from the voltage generating means and the ramp wave generating means, respectively, for a corresponding section; and, a count means for adjusting the time an adding result of the adding means is applied.

4. The LCD driving circuit as claimed in claim 3, wherein the voltage generating means comprises:

a voltage generating part for generating a voltage source for each section along the a T axis of the T-V curve; and, a selecting part for outputting one of the plurality of voltage sources according to input data.

5. The LCD driving circuit as claimed in claim 3, wherein the ramp wave generating means comprises:

a ramp wave generating part for generating a plurality of ramp waves having appropriate tilts at the sections set by the voltage generating means; and, a selecting part for selecting one of the plurality of ramp waves according to the input data.

6. The LCD driving circuit as claimed in claim 3, wherein each of the tilts of the ramp waves generated by the ramp wave generating means is $((V_{i+1}+V_i)\times 1\ H)$, in which $V_{i+1}$ is a voltage of a section right after a predetermined number of the sections, and $V_i$ is a voltage of a section just prior to the section, and 1 H is a selecting time of line 1.

7. The LCD driving circuit as claimed in claim 3, wherein the adding means inlcudes an adder using an operational amplifier.

8. The LCD driving circuit as claimed in claim 3, wherein the count means comprises:

a counter for counting a predetermined number of as many as predetermined steps between the sections set according to the input data;

a switching means for outputting an adding result of the adding means when activated by the counter; and, a latch for maintaining the adding result of the adding means for a predetermined time after the switching means is turned off by the count means.

9. The LCD driving circuit as claimed in claim 8, wherein the time for counting by the counter plus the time for maintaining by the latch equals the selecting time 1 H of line 1.

10. The LCD driving circuit as claimed in claim 8, wherein while the counter is counting, an output of the adding means is increased from the selected voltage source to the selected ramp wave form.

11. A method for driving a liquid crystal display (LCD) comprising the steps of:

generating a plurality of ramp waves each having an appropriate tilt for each section along a T axis of a T-V (transmission-voltage) curve representing the light transmittivity of an LCD according to an applied voltage; selecting one of the plurality of ramp waves according to input data; and, adjusting a time the ramp wave outputted by the ramp wave selecting means is applied.

12. A method for driving an LCD comprising the steps of:

generating voltage sources each corresponding to sections along a T axis of a T-V (transmissivity-voltage) curve representing the light transmittivity of an LCD according to an applied voltage;

generating ramp waves each having an appropriate tilt for each of the sections;

adding the voltage source and ramp wave generated from the voltage generating means and the ramp wave generating means, respectively, for a corresponding section; and, adjusting the time an adding result of the adding means is applied.

13. A liquid crystal display (LCD) driving circuit comprising:

a ramp wave generator producing a plurality of ramp waves, the ramp waves having different tilts;

a ramp wave selector receiving the plurality of ramp waves and selecting one ramp wave corresponding to a first digital data; and a switching part applying the selected ramp wave to a panel of the LCD for a predetermined time, the predetermined time being determined by a second digital data.

14. The liquid crystal display (LCD) driving circuit in claim 13, the circuit further including a counter receiving the second digital data and controlling the switching part.

15. The liquid crystal display (LCD) driving circuit in claim 13, the circuit further including:

a voltage generator producing a plurality of DC voltages;

a voltage selector receiving the plurality of DC voltages and selecting one DC voltage corresponding to the first digital data; and an adder adding the selected ramp wave and the selected DC voltage.

16. The liquid crystal display (LCD) driving circuit in claim 15, wherein the first digital data and second digital data comprise all bits of display data.

17. The liquid crystal display (LCD) driving circuit in claim 15, the circuit further including a counter receiving the second digital data and controlling the switching part.

18. The liquid crystal display (LCD) driving circuit in claim 13, wherein the first digital data and second digital data comprise all bits of display data.

19. The liquid crystal display (LCD) driving circuit in claim 13, the circuit further including a buffer between the switching part and the panel.

20. The liquid crystal display (LCD) driving circuit in claim 13, wherein the second digital data includes the first digital data.

* * * * *